US008262508B2

(12) United States Patent
Nakamura et al.

(10) Patent No.: US 8,262,508 B2
(45) Date of Patent: Sep. 11, 2012

(54) GOLF BALL

(75) Inventors: Hirotaka Nakamura, Kobe (JP); Keiji Ohama, Kobe (JP)

(73) Assignee: SRI Sports Limited, Kobe (JP)

( * ) Notice: Subject to any disclaimer, the term of this patent is extended or adjusted under 35 U.S.C. 154(b) by 506 days.

(21) Appl. No.: 12/508,294

(22) Filed: Jul. 23, 2009

(65) Prior Publication Data

US 2010/0056301 A1 Mar. 4, 2010

(30) Foreign Application Priority Data

Aug. 28, 2008 (JP) ..... 2008-218924
Nov. 21, 2008 (JP) ..... 2008-297451

(51) Int. Cl.
*A63B 37/06* (2006.01)

(52) U.S. Cl. ..... 473/351; 473/358

(58) Field of Classification Search ..... 473/358, 473/351
See application file for complete search history.

(56) References Cited

U.S. PATENT DOCUMENTS 6,182,970 B1 2/2001 Fushihara et al.
6,200,230 B1 * 3/2001 Maruko ..... 473/354
6,200,231 B1 * 3/2001 Moriyama et al. ..... 473/358

FOREIGN PATENT DOCUMENTS

JP 3-63354 U 6/1991
JP 11-76464 A 3/1999

* cited by examiner

*Primary Examiner* — Raeann Gorden
(74) *Attorney, Agent, or Firm* — Birch, Stewart, Kolasch & Birch, LLP

(57) ABSTRACT

A golf ball 2 has a hollow center 8, a mid layer 10, an inner cover 12 and an outer cover 14. The center 8 is formed by crosslinking a rubber composition. The rubber composition contains a natural rubber as a base polymer. The rubber composition contains sulfur. The mid layer 10 is formed by crosslinking a rubber composition. This rubber composition includes butadiene as a principal component of the base polymer. The center 8 has an inside diameter of 2 mm or greater and 13 mm or less. The center 8 has an outside diameter of 5 mm or greater and 15 mm or less. The center 8 has a surface JIS-C hardness H2 of 25 or greater and 55 or less. A difference (H4–H3) between a surface JIS-C hardness H4 of the mid layer 10 and a JIS-C hardness H3 of an innermost part of the mid layer is equal to or greater than 10.

20 Claims, 2 Drawing Sheets

GOLF BALL

This application claims priority on Patent Application No. 2008-218924 filed in JAPAN on Aug. 28, 2008, and Patent Application No. 2008-297451 filed in JAPAN on Nov. 21, 2008. The entire contents of the Japanese Patent Applications are hereby incorporated by reference.

BACKGROUND OF THE INVENTION

1. Field of the Invention

The present invention relates to golf balls. More particularly, the present invention relates to multi-piece golf balls having a center, a mid layer and a cover.

2. Description of the Related Art

Golf players' greatest demand for golf balls is flight performance. Golf players emphasize flight performance with a driver, a long iron and a middle iron. The flight performance is correlated with spin rate. The golf ball flies at a small spin rate, thereby obtaining proper trajectory to accomplish great flight distance. In light of flight performance, golf balls which are not likely to be spun are desired.

When a golf ball has an outer-hard/inner-soft structure, the spin may be suppressed. The conventional golf ball uses a soft center, a hard mid layer and a hard cover in order to attain an outer-hard/inner-soft structure. In this golf ball, the hardness distribution up to the central point of a center from the surface of a mid layer has a large level difference on the boundary of the center and the mid layer. This level difference deteriorates the suppression of spin.

When an inertia moment is set to be large, the spin may be suppressed. A golf ball having a hollow structure may attain a large inertia moment. A variety of golf balls having the hollow structure have been proposed. Japanese Unexamined Utility Model Application Publication No. 3-63354 discloses a golf ball which is made of a hard rubber or a hard plastic, and has a spherical body encapsulating high-pressure air therein. Japanese Unexamined Patent Application Publication No. 11-76464 discloses a golf ball having a hollow center. Japanese Unexamined Patent Application Publication No. 11-128399 (U.S. Pat. No. 6,182,970) discloses a golf ball having a hollow core.

According to the golf ball disclosed in Japanese Unexamined Utility Model Application Publication No. 3-63354, a layer covering a space portion is hard. The space portion has a hardness of zero. In this golf ball, a hardness difference between the space portion and the portion covering the space portion is large. When this golf ball is hit, the portion covering the space portion is deformed significantly. Since the portion covering the space portion has small recoil, excessive spin is caused.

According to the golf ball disclosed in Japanese Unexamined Patent Application Publication No. 11-76464, a rubber layer of the center is hard. This golf ball has a large hardness difference between the space portion and the rubber layer. When the golf ball is hit, the rubber layer is deformed significantly. Since the rubber layer has small recoil, excessive spin is caused.

According to the golf ball disclosed in Japanese Unexamined Patent Application Publication No. 11-128399, a rubber layer of a core is hard. This golf ball has a large hardness difference between the space portion and the rubber layer. When the golf ball is hit, the rubber portion is deformed significantly. Since the rubber layer has small recoil, excessive spin is caused.

It is an object of the present invention to provide a golf ball having great flight distance by suppressing the spin.

SUMMARY OF THE INVENTION

A golf ball according to the present invention includes a core and a cover positioned outside the core. This core has a hollow center and a mid layer positioned outside the center. The center has an inside diameter of 2 mm or greater and 13 mm or less. The center has an outside diameter of 5 mm or greater and 15 mm or less. A JIS-C hardness H2 of a surface of the center is 25 or greater and 55 or less. A difference (H4−H3) between a JIS-C hardness H4 of a surface of the core and a JIS-C hardness H3 of an innermost part of the mid layer is equal to or greater than 10.

Since this golf ball has small hardness H2, the hardness difference between the space portion and the portion covering the space portion is small. In this golf ball, the diameter of the center is small and the hardness difference (H4−H3) of the mid layer is large. Therefore, the level difference of the hardness on the boundary of the center and the mid layer is small. The conventional golf ball has an outer-hard/inner-soft structure having inferior continuity of hardness distribution. On the other hand, the golf ball according to the present invention has an outer-hard/inner-soft structure having excellent continuity of hardness distribution. In this golf ball, the spin is sufficiently suppressed. This golf ball is excellent in flight performance.

Preferably, a difference (H2−H1) between the hardness H2 and a JIS-C hardness H1 of an innermost part of the center is 1 or greater and 15 or less. Preferably, a difference (H3−H2) between the hardness H3 and the hardness H2 is equal to or less than 35. Preferably, a difference (H4−H2) between the hardness H4 and the hardness H2 is equal to or greater than 40.

Preferably, the JIS-C hardness H1 of the innermost part of the center is equal to or less than 35. Preferably, the hardness H3 is 45 or greater and 75 or less. Preferably, the hardness H4 is 65 or greater and 90 or less.

The center may be formed by crosslinking a rubber composition. Preferably, the rubber composition contains sulfur as a crosslinking agent.

Preferably, the rubber composition of the center contains 100 parts by weight of base rubber and 2.0 parts by weight or greater and 10.0 parts by weight or less of the sulfur. Preferably, the rubber composition contains 100 parts by weight of base rubber and 0.5 parts by weight or greater and 7.0 parts by weight or less of vulcanization accelerator. Preferably, the rubber composition contains 100 parts by weight of base rubber and 3 parts by weight or greater and 20 parts by weight or less of silica. Preferably, the rubber composition contains natural rubber.

The mid layer may be formed by crosslinking of a rubber composition. Preferably, a base rubber of the rubber composition contains polybutadiene as a principal component. Preferably, the rubber composition contains 0.1 part by weight or greater and 1.5 parts by weight or less of organic sulfur compound per 100 parts by weight of the base rubber. Preferably, the mid layer has a thickness of 10 mm or greater and 20 mm or less.

The cover may include an inner cover and an outer cover. Preferably, a Shore D hardness H5 of the inner cover is smaller than a Shore D hardness H6 of the outer cover. Preferably, a difference (H6−H5) between the hardness H6 and the hardness H5 is equal to or greater than 10. Preferably, the hardness H5 is 20 or greater and 50 or less. Preferably, the hardness H6 is equal to or greater than 57. The inner cover may be formed of a thermoplastic resin composition. The outer cover may be formed of a thermoplastic resin composition.

DESCRIPTION OF THE PREFERRED EMBODIMENTS

The present invention will be hereinafter described in detail with appropriate references to the accompanying drawing, according to preferred embodiments.

Figure 1:
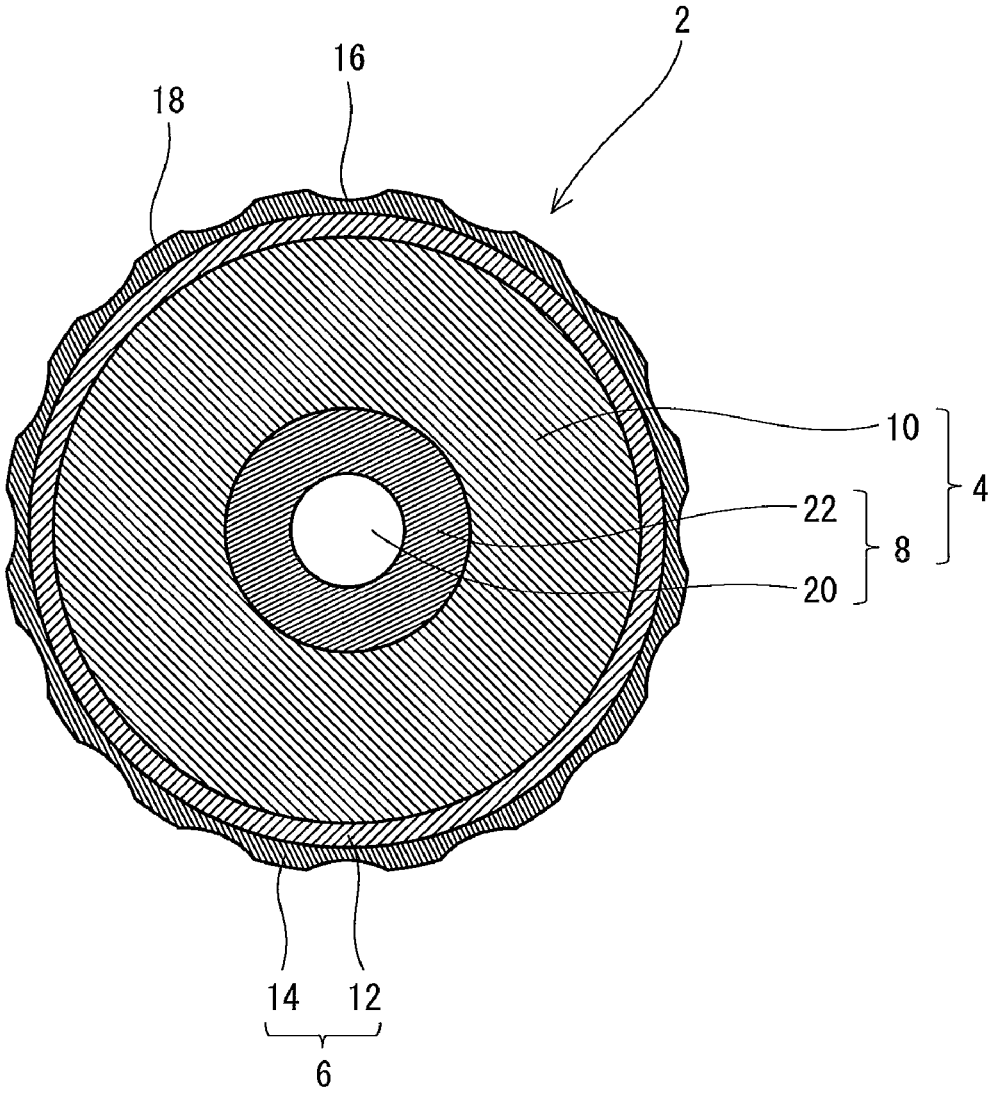
FIG. 1 shows a schematic cross-sectional view illustrating a golf ball according to one embodiment of the present invention

A golf ball 2 shown in FIG. 1 has a spherical core 4 and a cover 6 positioned outside the core 4. The core 4 has a spherical center 8 and a mid layer 10 positioned outside the center 8. The center 8 may have a surface provided with a rib. The cover 6 includes an inner cover 12 and an outer cover 14. The cover 6 may have a single layer. Numerous dimples 16 are formed on the surface of the cover 14. Of the surface of the golf ball 2, a part other than the dimples 16 is land 18. This golf ball 2 has a paint layer and a mark layer on the external side of the outer cover 14, although these layers are not shown in the Figure.

This golf ball 2 has a diameter of 40 mm or greater and 45 mm or less. From the standpoint of conformity to the rules defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. This golf ball 2 has a weight of 40 g or greater and 50 g or less. In light of attainment of great inertia, the weight is preferably equal to or greater than 44 g, and more preferably equal to or greater than 45.00 g. From the stand point of conformity to the rules defined by USGA, the weight is preferably equal to or less than 45.93 g.

The center 8 has a spherical space 20 and an outer layer 22. In other words, the center 8 is hollow. Theoretically, the space 20 has a hardness of zero. The center 8 having the space 20 has an ultimate inner-soft structure.

The center 8 is obtained by crosslinking a rubber composition. Illustrative examples of preferable base rubber include natural rubbers, polybutadienes, polyisoprenes, styrene-butadiene copolymers, ethylene-propylene-diene copolymers. Two or more kinds of the rubbers may be used in combination.

As described later, the outer layer 22 is soft. In light of the soft of the out layer 22, the natural rubber is preferably used as a base rubber. When other rubber is used in combination with the natural rubber, it is preferred that the percentage of the natural rubber in the entire base rubber is equal to or greater than 30% by weight, and more preferably equal to or greater than 40% by weight.

In light of resilience performance of the golf ball 2, the rubber composition of the center 8 contains polybutadienes together with natural rubbers. Specifically, it is preferred that the percentage of polybutadiene in the entire base rubber is equal to or greater than 30% by weight, and more preferably equal to or greater than 40% by weight. Preferably, polyurethanes have a percentage of cis-1,4 bonds of equal to or greater than 40%, and more preferably equal to or greater than 80%.

When the natural rubber and the polybutadiene are used in combination into the rubber composition of the center 8, the weight ratio of both is preferably equal to or greater than 3/7 and equal to or less than 7/3, and more preferably equal to or greater than 4/6 and equal to or less than 6/4.

The rubber composition of the center 8 contains sulfur. The sulfur crosslinks rubber molecules mutually. The outer layer 22 obtained by sulfur-crosslinking is soft. The outer layer 22 suppresses the level difference between the space 20 and the outer layer 22. The soft outer layer 22 accomplishes an excellent outer-hard/inner-soft structure having excellent continuity of hardness distribution of the center 8. The center 8 suppresses the spin. The center 8 contributes also to soft feel at impact.

In light of the resilience performance of the golf ball 2, the amount of the sulfur is preferably equal to or greater than 2.0 parts by weight, and particularly preferably equal to or greater than 3.0 parts by weight per 100 parts by weight of the base rubber. In light of the soft of the outer layer 22, the amount of the sulfur is preferably equal to or less than 10.0 parts by weight, and particularly preferably equal to or less than 6.5 parts by weight.

Preferably, the rubber composition of the center 8 contains a vulcanization accelerator. The vulcanization accelerator accomplishes the short crosslinking time of the center 8. A guanidine vulcanization accelerator, a thiazole vulcanization accelerator, a sulfenamide vulcanization accelerator, an aldehyde ammonia vulcanization accelerator, a thiourea vulcanization accelerator, a thiuram vulcanization accelerator, a dithiocarbamate vulcanization accelerator, a xanthate vulcanization accelerator and the like may be used. The guanidine vulcanization accelerator, the thiazole vulcanization accelerator and the sulfenamide vulcanization accelerator are preferred. Two or more kinds of vulcanization accelerators may be used in combination.

Illustrative examples of the guanidine vulcanization accelerator include 1,3-diphenylguanidine, 1,3-di-o-tolylguanidine, 1-o-tolylbiguanide and di-o-tolylguanidine salt of dicatechol borate. Specific examples of 1, 3-diphenylguanidine include trade names "NOCCELER D" and "NOCCELER D-P", available from Ouchi Shinko Chemical Industrial Co., Ltd.; and trade names "SOXINOL D", "SOXINOL DG" and "SOXINOL DO", available from Sumitomo Chemical Co., Ltd. Specific examples of 1, 3-di-o-tolylguanidine include trade name "NOCCELER DT", available from Ouchi Shinko Chemical Industrial Co., Ltd.; and trade names "SOXINOL DT" and "SOXINOL DT-O", available from Sumitomo Chemical Co., Ltd. Specific examples of 1-o-tolylbiguanide include trade name "NOCCELER BG", available from Ouchi Shinko Chemical Industrial Co., Ltd. Specific examples of di-o-tolylguanidine salt of dicatechol borate include trade name "NOCCELER PR", available from Ouchi Shinko Chemical Industrial Co., Ltd.

Illustrative examples of the thiazole vulcanization accelerator include 2-mercaptobenzothiazole, di-2-benzothiazolyl disulfide, 2-mercaptobenzothiazole zinc salt, 2-mercaptobenzothiazole cyclohexylamine salt, 2-(N,N-diethylthiocarbamoylthio)benzothiazole and 2-(4'-morpholinodithio)benzothiazole. Specific examples of 2-mercaptobenzothiazole include trade names "NOCCELER M" and "NOCCELERM-P", available from Ouchi Shinko Chemical Industrial Co., Ltd. Specific examples of di-2-benzothiazolyl disulfide include trade names "NOCCELER DM" and "NOCCELER DM-P", available from Ouchi Shinko Chemical Industrial Co., Ltd. Specific examples of 2-mercaptobenzothiazole zinc salt include trade name "NOCCELER MZ", available from Ouchi Shinko Chemical Industrial Co., Ltd. Specific examples of 2-mercaptobenzothiazole cyclohexylamine salt include trade name "NOCCELER M-60-OT", available from Ouchi Shinko Chemical Industrial Co., Ltd. Specific examples of 2-(N,N-diethylthiocarbamoylthio)benzothiazole include trade name "NOCCELER 64", available from Ouchi Shinko Chemical Industrial Co., Ltd. Specific examples of 2-(4'-morpholinodithio)benzothiazole include trade names "NOCCELER MDB" and "NOCCELER MDB-P", available from Ouchi Shinko Chemical Industrial Co., Ltd.

Illustrative examples of the sulfenamide vulcanization accelerator include N-cyclohexyl-2-benzothiazolylsulfenamide, N-tert-butyl-2-benzothiazolylsulfenamide, N-oxydiethylene-2-benzothiazolylsulfenamide and N,N'-dicyclohexyl-2-benzothiazolylsulfenamide. Specific examples of N-cyclohexyl-2-benzothiazolylsulfenamide include trade names "NOCCELER CZ" and "NOCCELER CZ-G", available from Ouchi Shinko Chemical Industrial Co., Ltd. Specific examples of N-tert-butyl-2-benzothiazolylsulfenamide include trade names "NOCCELER NS" and "NOCCELER NS-P", available from Ouchi Shinko Chemical Industrial Co., Ltd. Specific examples of N-oxydiethylene-2-benzothiazolylsulfenamide include trade name "NOCCELER MSA-G", available from Ouchi Shinko Chemical Industrial Co., Ltd. Specific examples of N,N'-dicyclohexyl-2-benzothiazolylsulfenamide include trade names "NOCCELER DZ" and "NOCCELER DZ-G", available from Ouchi Shinko Chemical Industrial Co., Ltd.

The amount of the vulcanization accelerator per 100 parts by weight of the base rubber is preferably equal to or greater than 0.5 parts by weight, and particularly preferably equal to or greater than 2.0 parts by weight. The amount of the vulcanization accelerator is preferably equal to or less than 7.0 parts by weight, and particularly preferably equal to or less than 5.0 parts by weight.

Generally, a rubber composition of a center of a golf ball contains an organic peroxide. The organic peroxide contributes to the resilience performance of the golf ball. On the other hand, the organic peroxide increases the hardness of the center. The center 8 of the golf ball 2 according to the present invention does not contain the organic peroxide. The rubber composition provides the soft outer layer 22.

Preferably, a reinforcing material is blended into the center 8. Preferable reinforcing material is silica (white carbon). Silica may accomplish the moderate rigidity of the center 8. Dried silica and wet silica may be used. In light of the rigidity of the center 8, the amount of silica per 100 parts by weight of the base rubber is preferably equal to or greater than 3 parts by weight, and particularly preferably equal to or greater than 5 parts by weight. In light of the soft of the center 8, the amount of silica is preferably equal to or less than 20 parts by weight, and particularly preferably equal to or less than 10 parts by weight. Together with silica, a silane coupling agent may be blended.

Into the center 8 may be blended a filler for the purpose of adjusting specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the filler is determined ad libitum so that the intended specific gravity of the outer layer 22 can be accomplished. Particularly preferable filler is zinc oxide. Zinc oxide serves not only to adjust the specific gravity but also as a cross linking activator.

clay may be used as a filler. Hard clay and soft clay may be used. The clay enhances air impermeability of the outer layer 22. The clay may prevent air present inside the space 20 from leaking out. Kaolin clay is particularly preferred.

Various kinds of additives such as an anti-aging agent, a coloring agent, a plasticizer, a dispersant, co-crosslinking agent, an organic sulfur compound and the like may be blended in an adequate amount to the center 8 as needed. Into the center 8 may be also blended crosslinked rubber powder or synthetic resin powder.

In light of the continuity of the hardness distribution, the hardness H1 of the innermost part of the center 8 is preferably equal to or less than 35, more preferably equal to or less than 32, and particularly preferably equal to or less than 29. In light of resilience performance and the durability, the hardness H1 is preferably equal to or greater than 15, more preferably equal to or greater than 20, and particularly preferably equal to or greater than 25. The central hardness H1 is measured by pressing a JIS-C type hardness scale on a cutting surface obtained by cutting the center 8 into halves. The hardness scale is pressed on an area surrounded by a first circle and a second circle. The first circle is a boundary between the space 20 and the outer layer 22. The second circle, which is concentric to the first circle, has a radius larger by 1 mm than that of the first circle. For the measurement, an automated rubber hardness tester (trade name "P1", available from KOBUNSHI KEIKI CO., LTD.) which is equipped with this hardness scale is used.

The hardness of the center 8 increases gradually toward the surface from the innermost part. The surface hardness H2 of the center 8 is larger than the hardness H1 of the inner most part. The larger surface hardness H2 may accomplish the continuity of the hardness between the center 8 and the mid layer 10. In this respect, the surface hardness H2 of the center 8 is preferably equal to or greater than 25, more preferably equal to or greater than 27, and particularly preferably equal to or greater than 30. In light of continuity of hardness distribution of the space 20 and the mid layer 10, the surface hardness H2 is preferably equal to or less than 55, more preferably equal to or less than 50, and particularly preferably equal to or less than 45. The surface hardness H2 is measured by pressing a JIS-C type hardness scale on the surface of the center 8. For the measurement, an automated rubber hardness tester (trade name "P1", available from KOBUNSHI KEIKI CO., LTD.) which is equipped with this hardness scale is used.

In light of feel at impact, a difference (H2−H1) between the surface hardness H2 and the hardness H1 of the innermost part is preferably equal to or greater than 1, more preferably equal to or greater than 2, and particularly preferably equal to or greater than 3. In light of resilience performance, the difference (H2−H1) is preferably equal to or less than 15, more preferably equal to or less than 10, and particularly equal to or less than 7.

In light of feel at impact, an amount D1 of compressive deformation of the center 8 is preferably equal to or greater than 1.0 mm, more preferably equal to or greater than 1.5 mm, and particularly preferably equal to or greater than 1.7 mm. In light of resilience performance, the amount D1 of compressive deformation is preferably equal to or less than 3.0 mm, more preferably equal to or less than 2.6 mm, and particularly preferably equal to or less than 2.4 mm.

Upon measurement of the amount of compressive deformation, the spherical body is placed on a hard plate made of metal. A cylinder made of metal gradually descends toward the spherical body. The spherical body intervened between the bottom face of the cylinder and the hard plate is deformed. A migration distance of the cylinder, starting from the state in which initial load is applied to the spherical body up to the state in which final load is applied thereto, is the amount of compressive deformation. Upon measurement of the amount of compressive deformation of the center 8, the initial load is 0.3N, and the final load is 29.4N. Upon measurements of an amount D2 of the compressive deformation of the core 4, an amount D3 of the compressive deformation of the spherical body including the core 4 and the inner cover 12 and an amount D4 of compressive deformation of the golf ball 2, the initial load is 98N, and the final load is 1274N.

In light of continuity of hardness distribution of the center 8, the center 8 has an inside diameter (an outside diameter of the space 20) of preferably equal to or greater than 2 mm and equal to or less than 13 mm. The inside diameter is preferably equal to or greater than 3 mm. The inside diameter is more preferably equal to or less than 10 mm, and particularly preferably equal to or less than 8 mm.

The outside diameter of the center 8 is smaller than that of the center of the general golf ball. The smaller center 8 may form the sufficiently thick mid layer 10. This mid layer 10 may accomplish an outer-hard/inner-soft structure having excellent continuity of hardness distribution. The smaller center 8 suppresses the spin. The smaller center 8 does not deteriorate the resilience performance of the golf ball 2, irrespective of being soft. In light of continuity of hardness distribution and resilience performance, the outside diameter of the center 8 is preferably equal to or less than 15 mm, more preferably equal to or less than 14 mm, and particularly preferably equal to or less 10 mm. In light of the center 8 capable of contributing to the suppression of the spin, the outside diameter of the center 8 is preferably equal to or greater than 5 mm.

The space 20 is massless. The golf ball 2 has a mass distribution which has a disproportionate pattern indicating greater weighing in the outer part. This mass distribution provides a large inertia moment. The large inertia moment suppresses the initial spin.

Figure 2:
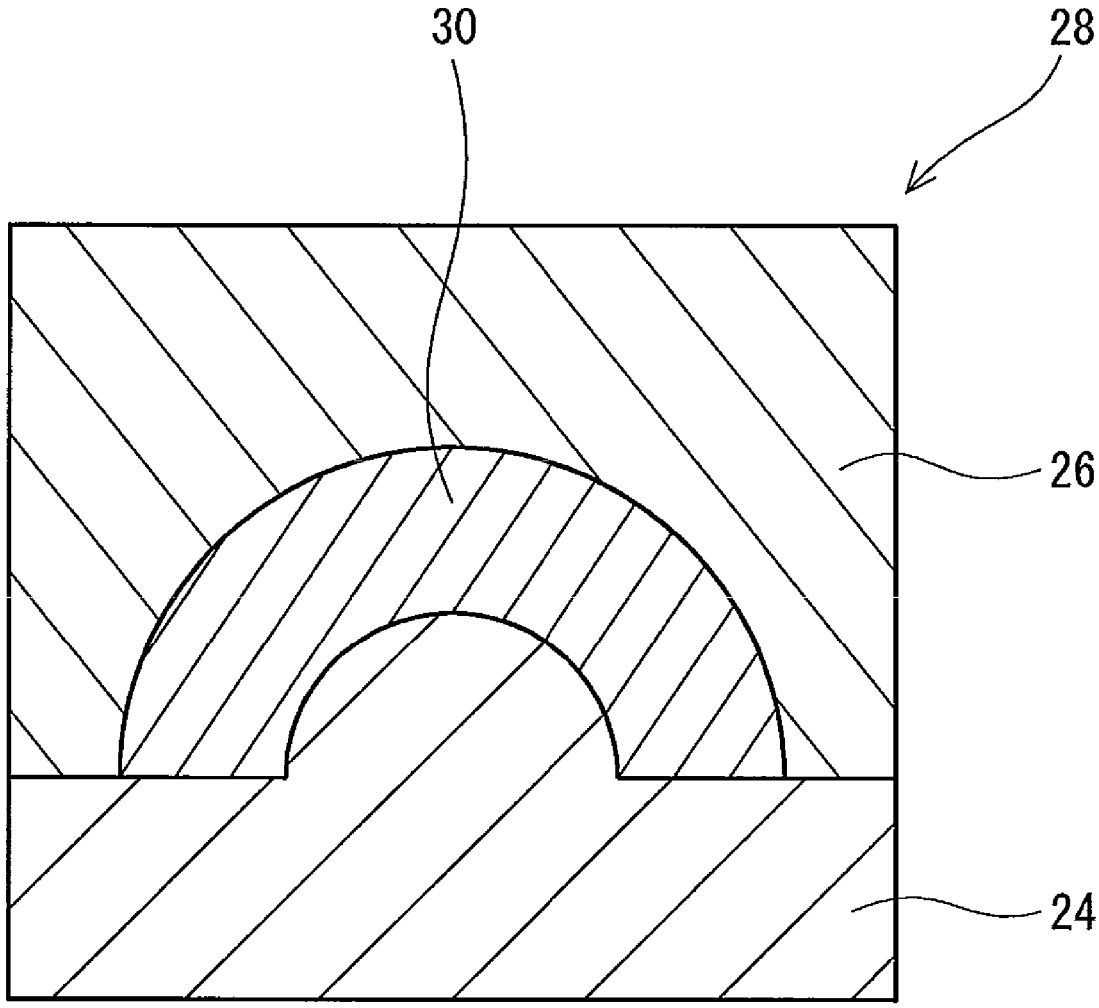
FIG. 2 is a cross-sectional view illustrating a mold used for forming a center of the golf ball shown in FIG. 1 together with a half shell.

For obtaining the center 8, a cavity of the mold 28 shown in FIG. 2 having a convex mold half 24 and a concave mold half 26 is filled with a rubber composition. The rubber composition is compressed and heated inside the cavity, thereby flowing to give a half shell 30. Upon the mold 28 is opened, the half shell 30 is taken out. The half shell 30 is in a state of unvulcanized or semi-vulcanized. Two half shells are mated each other and then they are placed into a mold having a spherical cavity. Inside the cavity, each half shell 30 is compressed and heated. The heating results in a crosslinking reaction of the rubber, thereby bonding each half shell 30 mutually. The bonding provides a hollow center 8. Prior to mating, bonding surfaces of each half shell are preferably applied with a rubber cement. Preferably, a rubber cement in which a rubber composition having the same composition as that of the center is dissolved in a solvent is used. Prior to mating, a compound which adds an internal pressure is preferably put into the half shell. Typical compound is ammonium chloride and sodium nitrite. Preferably, tablets of ammonium chloride, tablets of sodium nitrite and water are put into the half shell. A chemical reaction between the ammonium chloride and the sodium nitrite generates nitrogen gas. The nitrogen gas raises the internal pressure of the center 8.

The mid layer 10 is obtained by crosslinking a rubber composition. Illustrative examples of preferable base rubber include polybutadienes, polyisoprenes, styrene-butadiene copolymers, ethylene-propylene-diene copolymers and natural rubbers. In light of resilience performance, polybutadienes are preferred. When other rubber is used in combination with polybutadiene, it is preferred that polybutadiene is included as a principal component. Specifically, a proportion of polybutadiene in the entire base rubber is preferably equal to or greater than 50% by weight, and more preferably equal to or greater than 80% by weight. Preferably, polyurethane has a proportion of cis-1,4 bonds of equal to or greater than 40%, and more preferably equal to or greater than 80%.

For crosslinking of the mid layer 10, a co-crosslinking agent is preferably used. Preferable examples of the co-crosslinking agent in light of the resilience performance include monovalent or bivalent metal salts of an α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate and zinc methacrylate are particularly preferred in light of the resilience performance.

As the co-crosslinking agent, an α,β-unsaturated carboxylic acid having 2 to 8 carbon atoms and a metal oxide may be also blended. Both components react in the rubber composition to give a salt. This salt contributes to the crosslinking reaction. Examples of preferable α,β-unsaturated carboxylic acid include acrylic acid and methacrylic acid. Examples of preferable metal oxide include zinc oxide and magnesium oxide.

In light of the resilience performance of the golf ball 2, the amount of the co-crosslinking agent is preferably equal to or greater than 10 parts by weight, and more preferably equal to or greater than 12 parts by weight per 100 parts by weight of the base rubber. In light of soft feel at impact, the amount of the co-crosslinking agent is preferably equal to or less than 30 parts by weight, and more preferably equal to or less than 20 parts by weight per 100 parts by weight of the base rubber.

Preferably, the rubber composition for use in the mid layer 10 includes the organic peroxide together with the co-crosslinking agent. The organic peroxide serves as a crosslinking initiator. The organic peroxide contributes to the resilience performance of the golf ball 2. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. In light of general versatility, dicumyl peroxide is preferred.

In light of the resilience performance of the golf ball 2, the amount of the organic peroxide is preferably equal to or greater than 0.1 parts by weight, more preferably equal to or greater than 0.3 parts by weight, and particularly preferably equal to or greater than 0.5 parts by weight per 100 parts by weight of the base rubber. In light of soft feel at impact, the amount of the organic peroxide is preferably equal to or less than 3.0 parts by weight, more preferably equal to or less than 2.5 parts by weight, and particularly preferably equal to or less than 2.0 parts by weight per 100 parts by weight of the base rubber.

Preferably, the rubber composition for use in the mid layer 10 includes an organic sulfur compound. Illustrative examples of preferable organic sulfur compound include mono-substituted forms such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; di-substituted forms such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide and bis(2-cyano-5-bromophenyl)disulfide; tri-substituted forms such as bis(2,4,6-trichlorophenyl)disulfide and bis(2-cyano-4-chloro-6-bromophenyl)disulfide; tetra-substituted forms such as bis(2,3,5,6-tetrachlorophenyl)disulfide; and penta-substituted forms such as bis(2,3,4,5,6-pentachlorophenyl)disulfide and bis(2,3,4,5,6-pentabromophenyl)disulfide. The organic sulfur compound contributes to the resilience performance. Particularly preferred organic sulfur compounds are diphenyl disulfide and bis(pentabromophenyl)disulfide.

In light of the resilience performance of the golf ball 2, the amount of the organic sulfur compound is preferably equal to or greater than 0.1 parts by weight, and more preferably equal to or greater than 0.2 parts by weight per 100 parts by weight of the base rubber. In light of soft feel at impact, the amount of the organic sulfur compound is preferably equal to or less than 1.5 parts by weight, more preferably equal to or less than 1.0 parts by weight, and particularly preferably equal to or less than 0.8 parts by weight per 100 parts by weight of the base rubber.

Into the mid layer 10 may be blended a filler for the purpose of adjusting specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the filler is determined ad libitum so that the intended specific gravity of the mid layer 10 can be accomplished. Particularly preferable filler is zinc oxide. Zinc oxide serves not only to adjust the specific gravity but also as a crosslinking activator. Various kinds of additives such as sulfur, an anti-aging agent, a coloring agent, a plasticizer, a dispersant and the like may be blended in an adequate amount to the mid layer 10 as needed. Into the mid layer 10 may be also blended crosslinked rubber powder or synthetic resin powder.

The mid layer 10 has a hardness gradually increase toward the surface (surface of the core 4) from the innermost part. The hardness H3 of the innermost part is small, and the hardness H4 of the surface is large. The small hardness H3 may accomplish continuity of hardness distribution of the center 8 and the mid layer 10. The large hardness H4 accomplishes an outer-hard/inner-soft structure of the core 4. The mid layer 10 suppresses the spin sufficiently.

In light of the resilience performance, the hardness H3 of the innermost part is preferably equal to or greater than 45, more preferably equal to or greater than 55, and particularly preferably equal to or greater than 63. In light of continuity of hardness distribution, the hardness H3 is preferably equal to or less than 75, more preferably equal to or less than 70, and particularly preferably equal to or less than 67. The hardness H3 is measured in a hemispherical body obtained by cutting the core 4. The hardness H3 is measured by pressing a JIS-C type hardness scale on the cutting surface of the hemispherical body. The hardness scale is pressed on an area surrounded by a first circle and a second circle. The first circle is a boundary between the center 8 and the mid layer 10. The second circle, which is concentric to the first circle, has a radius larger by 1 mm than that of the first circle. For the measurement, an automated rubber hardness tester (trade name "P1", available from KOBUNSHI KEIKI CO., LTD.) which is equipped with this hardness scale is used.

In light of an outer-hard/inner-soft structure being accomplished, the surface hardness H4 of the core 4 is preferably equal to or greater than 65, more preferably equal to or greater than 75, and particularly preferably equal to or greater than 81. In light of feel at impact, the hardness H4 is preferably equal to or less than 90, and more preferably equal to or less than 85. The hardness H4 is measured by pressing the JIS-C type hardness scale on the surface of the core 4. For the measurement, an automated rubber hardness tester (trade name "P1", available from KOBUNSHI KEIKI CO., LTD.) which is equipped with this hardness scale is used.

In light of suppression of the spin, the difference (H4−H3) between the surface hardness H4 of the core 4 and the hardness H3 of the innermost part of the mid layer 10 is preferably equal to or greater than 10, more preferably equal to or greater than 13, and particularly preferably equal to or greater than 14. In light of ease in manufacture, the difference (H4−H3) is preferably equal to or less than 25, more preferably equal to or less than 20, and particularly preferably equal to or less than 18.

In light of the larger difference (H4−H3) capable of being accomplished, the thickness of the mid layer 10 is preferably equal to or greater than 10 mm, more preferably equal to or greater than 11 mm, and particularly preferably equal to or greater than 12 mm. The thickness is preferably equal to or less than 20 mm.

The crosslinking temperature for the mid layer 10 is usually 140° C. or greater and 180° C. or less. The crosslinking time of the mid layer 10 is usually 10 minutes or longer and 60 minutes or less.

In light of continuity of hardness distribution, the difference (H3−H2) between the hardness H3 of the innermost part of the mid layer 10 and the surface hardness H2 of the center 8 is preferably equal to or less than 35 and more preferably equal to or less than 33. The difference (H3−H2) may be zero.

In light of the suppression of the spin, a difference (H4−H1) between the surface hardness H4 of the core 4 and the hardness H1 of the innermost part of the center 8 is preferably equal to or greater than 40, more preferably equal to or greater than 43, and particularly preferably equal to or greater than 46. In light of ease in manufacture, the difference (H4−H1) is preferably equal to or less than 65, more preferably equal to or less than 60, and particularly preferably equal to or less than 51.

In light of feel at impact, the amount D2 of compressive deformation of the core 4 is preferably equal to or greater than 2.3 mm, more preferably equal to or greater than 2.4 mm, and particularly preferably equal to or greater than 2.5 mm. In light of resilience performance, the amount D2 of compressive deformation is preferably equal to or less than 4.0 mm, more preferably equal to or less than 3.5 mm, and particularly preferably equal to or less than 3.0 mm.

In light of the resilience performance, the core 4 has a diameter of preferably equal to or greater than 30.0 mm, more preferably equal to or greater than 35.0 mm, and particularly preferably equal to or greater than 38.0 mm. In light of durability of the golf ball 2, the core 4 has a diameter of preferably equal to or less than 40.2 mm, more preferably equal to or less than 39.9 mm, and particularly preferably equal to or less than 39.6 mm.

As described above, this golf ball 2 has the inner cover 12 and the outer cover 14. The inner cover 12 is soft, and the outer cover 14 is hard. This outer cover 14 accomplishes an outer-hard/inner-soft structure of the golf ball 2. This golf ball 2 suppresses the spin. The outer cover 14 accomplishes further excellent resilience performance of the golf ball 2. The inner cover 12 may absorb the shock at impact since it is soft. This inner cover 12 accomplishes soft feel at impact of the golf ball 2, irrespective of the outer cover 14 being hard.

A resin composition is suitably used for the inner cover 12. Illustrative examples of the base polymer of the resin composition include an ionomer resin, styrene block-containing thermoplastic elastomer, thermoplastic polyester elastomer, thermoplastic polyamide elastomer and thermoplastic polyolefin elastomer.

The ionomer resin is particularly preferred as the base polymer. The ionomer resin is highly elastic. The golf ball 2 having the inner cover 12 containing the ionomer resin is excellent in resilience performance. The ionomer resin and other resin may be used in combination. When they are used in combination, in light of resilience performance, a proportion of the ionomer resin in the entire base polymer is preferably equal to or greater than 30% by weight, more preferably equal to or greater than 40% by weight, and particularly preferably equal to or greater than 45%.

Examples of preferred ionomer resin include binary copolymers formed with α-olefin and an α,β-unsaturated carboxylic acid having 3 to 8 carbon atoms. Preferable binary copolymer includes 80% by weight or greater and 90% by weight or less of α-olefine and 10% by weight or greater and 20% by weight or less of α,β-unsaturated carboxylic acid. This binary copolymer provides excellent resilience performance. Examples of preferable other ionomer resins include ternary copolymers formed with α-olefine, an α,β-unsaturated carboxylic acid having 3 to 8 carbon atoms, and an α,β-unsaturated carboxylate ester having 2 to 22 carbon atoms. Preferable ternary copolymer comprises 70% by weight or greater and 85% by weight or less of α-olefin, 5% by weight or greater 30% by weight or less of α,β-unsaturated carboxylic acid, and 1% by weight or greater and 25% by weight or less of α,β-unsaturated carboxylate ester. This ternary copolymer has excellent resilience performance. In the binary and ternary copolymers, preferable α-olefin is ethylene and propylene, and preferable α,β-unsaturated carboxylic acid is acrylic acid and methacrylic acid. Particularly preferred ionomer resin is a copolymer formed with ethylene, and acrylic acid or methacrylic acid.

In the binary and ternary copolymers, a part of the carboxyl groups is neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability of the golf ball 2 is sodium ion, zinc ion, lithium ion and magnesium ion.

Specific examples of the ionomer resin include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan MK7320" and "Himilan MK7329", available from Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF 1000" and "HPF 2000", available from Du Pont Kabushiki Kaisha; and trade names "IOTEK 7010", "IOTEK 7030", "IOTEK 7510", "IOTEK 7520", "IOTEK 8000" and "IOTEK 8030", available from EXXON Mobil Chemical Corporation.

Two or more kinds of the ionomer resins may be used in combination into the inner cover 12. An ionomer resin neutralized with a monovalent metal ion, and an ionomer resin neutralized with a bivalent metal ion may be used in combination.

The preferable resin which may be used in combination with the ionomer resin is the styrene block-containing thermoplastic elastomer. This elastomer may contribute to feel at impact of the golf ball 2. The elastomer does not deteriorate the resilience performance of the golf ball 2. The elastomer includes a polystyrene block as a hard segment, and a soft segment. Typical soft segment is a diene block. Illustrative examples of a diene block compounds include butadiene, isoprene, 1,3-pentadiene and 2,3-dimethyl-1,3-butadiene. Butadiene and isoprene are preferred. Two or more compounds may be used in combination.

The styrene block-containing thermoplastic elastomer may include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS and a hydrogenated product of SIBS. Example of hydrogenated product of SBS is a styrene-ethylene-butylene-styrene block copolymer (SEBS). Exemplary hydrogenated product of SIS is a styrene-ethylene-propylene-styrene block copolymer (SEPS). Exemplary hydrogenated product of SIBS is a styrene-ethylene-ethylene-propylene-styrene block copolymer (SEEPS).

In light of the resilience performance of the golf ball 2, the content percentage of the styrene component in the thermoplastic elastomer is preferably equal to or greater than 10% by weight, more preferably equal to or greater than 12% by weight, and particularly preferably equal to or greater than 15% by weight. In light of the feel at impact of the golf ball 2, the content percentage is preferably equal to or less than 50% by weight, more preferably equal to or less than 47% by weight, and particularly preferably equal to or less than 45% by weight.

In the present invention, the styrene block-containing thermoplastic elastomer includes an alloy of olefin with one or more selected from the group consisting of SBS, SIS, SIBS, SEBS, SEPS and SEEPS, and hydrogenated products thereof. The olefin component in this alloy is speculated to contribute to improvement of the compatibility with the ionomer resin. When this alloy is used, the resilience performance of the golf ball 2 is improved. Preferably, olefin having 2 to 10 carbon atoms is used. Illustrative examples of suitable olefin include ethylene, propylene, butene and pentene. Ethylene and propylene are particularly preferred.

Specific examples of the polymer alloy include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N" and "Rabalon SR04", available from Mitsubishi Chemical Corporation. Other specific examples of the styrene block-containing thermoplastic elastomer include a trade name "Epofriend A1010", available from DAICEL CHEMICAL INDUSTRIES, LTD.; and a trade name "Septon HG-252", available from KURARAY CO., LTD.

When the ionomer resin and the styrene block-containing thermoplastic elastomer is used in combination into the inner cover 12, the weight ratio of both is preferably equal to or greater than 30/70 and equal to or less than 95/5. The inner cover 12 having the ratio of equal to or greater than 30/70 contributes to the resilience performance of the golf ball 2. In this respect, the ratio is more preferably equal to or greater than 40/60, and particularly preferably equal to or greater than 50/50. The inner cover 12 having the ratio of equal to or less than 95/5 contributes to feel at impact of the golf ball 2. In this respect, the ratio is more preferably equal to or less than 80/20, and particularly preferably equal to or less than 70/30.

Into the inner cover 12 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate a mount as needed. Known techniques such as injection molding and compression molding may be adopted for the formation of the inner cover 12.

In light of the resilience performance, the hardness H5 of the inner cover 12 is preferably equal to or greater than 20, more preferably equal to or greater than 25, and particularly preferably equal to or greater than 30. In light of the feel at impact, the hardness H5 is preferably equal to or less than 50, more preferably equal to or less than 45, and particularly preferably equal to or less than 40.

The hardness H5 may be measured in accordance with a standard of "ASTM-D 2240-68" by using a D type shore spring hardness scale attached to an automated rubber hardness tester (trade name "PI", available fromKOBUNSHI KEIKI CO., LTD.). For the measurement, a slab formed by hot pressing to have a thickness of about 2 mm is used. Prior to the measurement, the slab is stored at a temperature of 23° C. for two weeks. When the measurement is carried out, three pieces of the slab are overlaid. In the measurement, a slab constituted with the same resin composition as that of the inner cover 12 is used.

In light of feel at impact, the inner cover 12 has the thickness of preferably equal to or greater than 0.3 mm, more preferably equal to or greater than 0.5 mm, and particularly preferably equal to or greater than 0.7 mm. In light of the resilience performance, the inner cover 12 has the thickness of preferably equal to or less than 2.5 mm, more preferably equal to or less than 2.0 mm, and particularly preferably equal to or less than 1.5 mm.

In light of feel at impact, the amount D3 of compressive deformation of the spherical body including the core 4 and the inner cover 12 is preferably equal to or greater than 2.3 mm, more preferably equal to or greater than 2.4 mm, and particularly preferably equal to or greater than 2.5 mm. In light of the resilience performance, the amount D3 of compressive deformation is preferably equal to or less than 4.0 mm, more preferably equal to or less than 3.9 mm, and particularly preferably equal to or less than 3.8 mm.

A resin composition is suitably used of the outer cover 14. Illustrative examples of the base polymer of the resin composition includes an ionomer resin, styrene block-containing thermoplastic elastomer, thermoplastic polyester elastomer, thermoplastic polyamide elastomer and thermoplastic polyorephin elastomer. The ionomer resin is particularly preferred. The ionomer resin is highly elastic. The golf ball 2 having the outer cover 14 containing the ionomer resin is excellent in resilience performance. The ionomer resin as described above in connection with the inner cover 12 can be used for the outer cover 14.

The ionomer resin and other resin may be used in combination. When they are used in combination, the ionomer resin is included as a principal component of the base polymer, in light of resilience performance. A proportion of the ionomer resin in the entire base polymer is preferably equal to or greater than 50% by weight, more preferably equal to or greater than 70% by weight, and particularly preferably equal to or greater than 85% by weight.

The preferable resin which may be used in combination with the ionomer resin is the styrene block-containing thermoplastic elastomer. The styrene block-containing thermoplastic elastomer as described above in connection with the inner cover 12 can be used for the outer cover 14.

When the ionomer resin and the styrene block-containing thermoplastic elastomer are used in combination into the outer cover 14, the weight ratio of both is preferably 60/40 or greater. The outer cover 14 having the ratio of equal to or greater than 60/40 contributes to resilience performance of the golf ball 2. In this respect, the ratio is more preferably equal to or greater than 75/25, and particularly preferably equal to or greater than 85/15.

Into the outer cover 14 may be blended with a coloring agent such as titanium dioxide, a filler such as barium sulfate, a dispersant, an antioxidant, an ultraviolet absorbent, alight stabilizer, a fluorescent agent, a fluorescent brightening agent and the like in an appropriate amount as needed. Known techniques such as injection molding and compression molding may be adopted for the formation of the outer cover 14. In molding the outer cover 14, dimples 16 are formed by multiple pimples formed in a cavity surface of a mold.

The outer cover 14 has the hardness H6 of preferably equal to or greater than 57. This outer cover 14 may accomplish an outer-hard/inner-soft structure of the golf ball 2. The golf ball 2 may suppress the spin. The outer cover 14 accomplishes excellent resilience performance of the golf ball 2. Owing to the suppression of the spin and the resilience performance, the golf ball 2 can accomplish great flight distance. In light of flight performance, the hardness H6 is more preferably equal to or greater than 59, and particularly preferably equal to or greater than 61. In light of feel at impact, the hardness H6 is preferably equal to or less than 75, and more preferably equal to or less than 70. For a measurement of the hardness H6, the slab containing the same resin composition as that of the outer cover 14 is used. The measurement is carried out in a same manner to the hardness H5 of the inner cover 12.

In light of flight performance, the outer cover 14 has a thickness of preferably equal to or greater than 0.3 mm, more preferably equal to or greater than 0.5 mm, and particularly preferably equal to or greater than 0.8 mm. In light of feel at impact, the outer cover 14 has a thickness of preferably equal to or less than 3.0 mm, and more preferably equal to or less than 2.5 mm, and particularly preferably equal to or less than 2.0 mm.

The Shore D hardness H5 of the inner cover 12 is smaller than the Shore D hardness H6 of the outer cover 14. This golf ball 2 can suppress the spin and obtain excellent feel at impact. In these respect, the difference (H6−H5) between the hardness H6 and the hardness H5 is preferably equal to or greater than 10, more preferably equal to or greater than 15, and particularly preferably equal to or greater than 20. The difference (H6−H5) is preferably equal to or less than 40.

In light of feel at impact, the amount D4 of compressive deformation of the golf ball 2 is preferably equal to or greater than 2.0 mm, more preferably equal to or greater than 2.1 mm, and particularly preferably equal to or greater than 2.2 mm. In light of resilience performance, the amount D4 of compressive deformation of the golf ball 2 is preferably equal to or greater than 2.0 mm, more preferably equal to or greater than 2.1 mm, and particularly preferably equal to or greater than 2.2 mm. In light of resilience performance, the amount D4 of compressive deformation is preferably equal to or less than 3.7 mm, more preferably equal to or less than 3.6 mm, and particularly preferably equal to or less than 3.5 mm.

EXAMPLES

Example 1

A rubber composition (a) was obtained by kneading 50 parts by weight of high-cis polybutadiene (trade name "BR-730", available from JSR Corporation), 50 parts by weight of natural rubber (KR-7), 5 parts by weight of zinc oxide, an adequate amount of clay, 5 parts by weight of silica (trade name "Nipsil AQ", available from TOSHO SILICA CORPORATION), 3.4 parts by weight of sulfur, 2.20 parts by weight of a vulcanization accelerator (aforementioned "NOCCELER CZ"), and 2.26 parts by weight of the other vulcanization accelerator (the aforementioned "SOXINOL DG"). This rubber composition (a) was placed into the mold shown in FIG. 2 to obtain a semi-vulcanized half shell. Ammonium chloride, sodium nitrite and water were put into the half shell. A rubber cement in which a rubber composition having the same composition as that of the center is dissolved in solvent was applied on a bonding surface of the half shell. The half shell and the other half shell mated each other. The half shells were placed into a mold having upper and lower mold halves, and heated at 150° C. for 5 minutes to obtain a hollow center having an inside diameter of 3.0 mm and an outside diameter of 5.0 mm.

A rubber composition (e) was obtained by kneading 100 parts by weight of high-cis polybutadiene (aforementioned "BR-730"), 12 parts by weight of zinc diacrylate, 5 parts by weight of zinc oxide, an adequate amount of barium sulfate, 0.5 parts by weight of diphenyl disulfide and 0.7 parts by weight of dicumyl peroxide (NOF Corporation.). A half shell was formed from this rubber composition (e). The center was covered with two half shells. The center and the half shells were placed into a mold having upper and lower mold halves, each of the halves having a hemispherical cavity, and heated at 170° C. for 20 minutes to obtain a core having a diameter of 38.2 mm. The amount of barium sulfate was adjusted so that the specific gravity of the mid layer corresponded to that of the center and the weight of the ball was made to be 45.6 g.

26 parts by weight of an ionomer resin (aforementioned "Surlyn 8945"), 26 parts by weight of other ionomer resin (aforementioned"Himilan 7329"), 48 parts by weight of a styrene block-containing thermoplastic elastomer (aforementioned "Rabalon T3221C") and 3 parts by weight of titanium dioxide were kneaded in a twin screw kneading extruder to obtain a resin composition (f) A core was placed into a mold which includes upper and lower mold halves, each of the halves having a hemispherical cavity. The aforementioned resin composition (f) was injected around the core by injection molding to form an inner cover. The inner cover had a thickness of 1.0 mm.

58 parts by weight of an ionomer resin (aforementioned "Surlyn 8945"), 40 parts by weight of other ionomer resin (aforementioned "Himilan AM7329"), 2 parts by weight of a styrene block-containing thermoplastic elastomer (aforementioned "Rabalon T3221C") and 3 parts by weight of titanium dioxide were kneaded in a twin screw kneading extruder to obtain a resin composition (g). A spherical body including an inner cover was placed into a final mold which includes upper and lower mold halves, each of the halves having a hemispherical cavity and which has a large number of pimples on its cavity face. The aforementioned resin composition (g) was injected around the sphere body by injection molding to form an outer cover. The outer cover had a thickness of 1.3 mm. Numerous dimples having a shape inverted from the shape of the pimple were formed on the outer cover. A clear paint including a two-part liquid curable polyurethane as a base was applied around this outer cover to give a golf ball of Example 1 having a diameter of 42.8 mm and a weight of 45.6 g.

Examples 2 to 4 and Comparative Examples 1 to 4

Golf balls of Examples 2 to 4 and Comparative Examples 1 to 4 were obtained in a similar manner to Example 1 except that specifications of the center, the mid layer, the inner cover and the outer cover were as listed in Tables 3 and 4 below. Details of the rubber composition of the center and the mid layer are presented in Table 1 below. Details of the resin composition of the inner cover and the outer cover are presented in Table 2 below. The golf ball according to Comparative Example 1 does not have the mid layer.

[Shot with Driver (W#1)]

A driver with a titanium head (trade name "XXIO", available from SRI Sports Limited, shaft hardness: R, loft angle: 11.0°) was attached to a swing machine available from Golf Laboratory Co. The golf balls were hit under a condition to give the head speed of 40 m/sec, and distance from the launching point to the point where the ball stopped was measured. A ball speed and backspin rate immediately after the impact were also measured. Mean values of data obtained by the measurement of 12 times are shown in Table 5 below.

[Shot with Iron Club (I#5)]

An iron club (#5) (trade name "XXIO", available from SRI Sports Limited, shaft hardness: R) was attached to the swing machine described above. The golf balls were hit under a condition to give the head speed of 34 m/sec, and distance from the launching point to the point where the ball stopped was measured. A ball speed and back spin rate immediately after the impact were also measured. Mean values of data obtained by the measurement of 12 times are shown in Table 5 below.

TABLE 1

Compositions of core (parts by weight)

| | (a) | (b) | (c) | (d) | (e) |
|---|---|---|---|---|---|
| Polybutadiene | 50 | 50 | 50 | 100 | 100 |
| Natural rubber | 50 | 50 | 50 | — | — |
| Zinc diacrylate | — | — | — | 15 | 37 |
| Zinc oxide | 5 | 5 | 5 | 5 | 5 |
| Barium sulfate | — | — | — | Adequate amount | Adequate amount |
| Clay | Adequate amount | Adequate amount | Adequate amount | — | — |
| Silica | 5 | 7 | 10 | — | — |
| Diphenyl disulfide | — | — | — | 0.5 | 0.5 |
| Dicumyl peroxide | — | — | — | 0.7 | 0.7 |
| Sulfur | 3.4 | 3.4 | 3.4 | — | — |
| Vulcanization accelerator CZ | 2.20 | 2.20 | 2.20 | — | — |
| Vulcanization accelerator DG | 2.26 | 2.26 | 2.26 | — | — |

TABLE 2

| Compositions of cover | | |
|---|---|---|
| | (f) | (parts by weight) (g) |
| Surlyn 8945 | 26 | 58 |
| Himilan AM7329 | 26 | 40 |
| Rabalon T3221C | 48 | 2 |
| Titanium dioxide | 3 | 3 |

TABLE 3

| Specifications of Golf ball | | | | | |
|---|---|---|---|---|---|
| | | Example 1 | Example 2 | Example 3 | Example 4 |
| Center | Composition | (a) | (b) | (c) | (c) |
| | Inside diameter (mm) | 3.0 | 4.0 | 5.0 | 8.0 |
| | Outside diameter (mm) | 5.0 | 7.0 | 10.0 | 14.4 |
| | Deformation amount D1 (mm) | 2.4 | 2.1 | 1.7 | 1.8 |
| | Innermost part hardness H1 (mm) | 27 | 29 | 32 | 32 |
| | Surface hardness H2 (JIS-C) | 30 | 32 | 37 | 37 |
| Mid layer | Composition | (e) | (e) | (e) | (e) |
| | Thickness (mm) | 16.6 | 15.8 | 14.6 | 12.3 |
| | Innermost part hardness H3 (JIS-C) | 63 | 65 | 67 | 66 |
| | Crosslinking temperature (° C.) | 170 | 170 | 170 | 170 |
| | Crosslinking time (min) | 20 | 20 | 20 | 20 |
| Core | Diameter (mm) | 38.2 | 38.6 | 39.2 | 39.0 |
| | Deformation D2 (mm) | 2.88 | 2.86 | 2.84 | 2.85 |
| | Surface hardness H4 (JIS-C) | 81 | 81 | 81 | 81 |
| | Difference (H3 – H2) | 33 | 33 | 32 | 31 |
| | Difference (H4 – H2) | 51 | 49 | 46 | 46 |
| | Difference (H4 – H3) | 18 | 16 | 14 | 15 |
| Inner cover | Composition | (f) | (f) | (f) | (f) |
| | Thickness (mm) | 1.0 | 1.0 | 1.0 | 1.0 |
| | Hardness H5 (Shore D) | 35 | 35 | 35 | 35 |
| Spherical body* | Diameter (mm) | 40.2 | 40.6 | 41.2 | 41.0 |
| | Deformation D3 (mm) | 2.68 | 2.66 | 2.64 | 2.65 |
| Outer cover | Composition | (g) | (g) | (g) | (g) |
| | Thickness (mm) | 1.3 | 1.1 | 0.8 | 0.9 |
| | Hardness H6 (Shore D) | 63 | 63 | 63 | 63 |
| Golf ball | Diameter (mm) | 42.8 | 42.8 | 42.8 | 42.8 |
| | Deformation D4 (mm) | 2.50 | 2.50 | 2.50 | 2.50 |

*a spherical body including a core and a cover

TABLE 4

| Specifications of Golf ball | | | | | |
|---|---|---|---|---|---|
| | | Compara. example 1 | Compara. example 2 | Compara. example 3 | Compara. example 4 |
| Center | Composition | (e) | (d) | (c) | (a) |
| | Inside diameter (mm) | — | — | 14.0 | 3.0 |
| | Outside diameter (mm) | 38.2 | 7.0 | 20.0 | 5.0 |
| | Deformation amount D1 (mm) | —** | 0.8 | 2.0 | 2.4 |
| | Innermost part hardness H1 (mm) | 62*** | 55*** | 35 | 27 |
| | Surface hardness H2 (JIS-C) | 81 | 61 | 41 | 30 |
| Mid layer | Composition | — | (e) | (e) | (e) |
| | Thickness (mm) | — | 15.8 | 9.6 | 16.6 |
| | Innermost part hadness H3 (JIS-C) | — | 65 | 72 | 72 |
| | Crosslinking temperature (° C.) | — | 170 | 170 | 150 |
| | Crosslinking time (min) | — | 20 | 20 | 30 |
| Core | Diameter (mm) | 38.2 | 38.6 | 39.2 | 38.2 |
| | Deformation D2 (mm) | 2.80 | 2.80 | 2.84 | 2.88 |
| | Surface hardness H4 (JIS-C) | 81(H2) | 81 | 81 | 81 |
| | Difference (H3 – H2) | — | 10 | 37 | 42 |
| | Difference (H4 – H2) | — | 26 | 46 | 51 |
| | Difference (H4 – H3) | — | 16 | 9 | 9 |

TABLE 4-continued

| Specifications of Golf ball | | | | | |
|---|---|---|---|---|---|
| | | Compara. example 1 | Compara. example 2 | Compara. example 3 | Compara. example 4 |
| Inner cover | Composition | (f) | (f) | (f) | (f) |
| | Thickness (mm) | 1.0 | 1.0 | 1.0 | 1.0 |
| | Hardness H5 (Shore D) | 35 | 35 | 35 | 35 |
| Spherical body* | Diameter (mm) | 40.2 | 40.6 | 41.2 | 40.2 |
| | Deformation D3 (mm) | 2.65 | 2.66 | 2.64 | 2.68 |
| Outer cover | Composition | (g) | (g) | (g) | (g) |
| | Thickness (mm) | 1.3 | 1.1 | 0.8 | 1.3 |
| | Hardness H6 (Shore D) | 63 | 63 | 63 | 63 |
| Golf ball | Diameter (mm) | 42.8 | 42.8 | 42.8 | 42.8 |
| | Deformation D4 (mm) | 2.50 | 2.50 | 2.50 | 2.50 |

*a spherical body including a core and a cover
**incapable measurement
***hardness of a central point

TABLE 5

| Results of evaluation | | | | | | | | | |
|---|---|---|---|---|---|---|---|---|---|
| | | Example 1 | Example 2 | Example 3 | Example 4 | Compara. example 1 | Compara. example 2 | Compara. example 3 | Compara. example 4 |
| W#1 | Initial velocity (m/s) | 59.1 | 59.1 | 59.0 | 58.9 | 59.2 | 59.1 | 58.7 | 59.1 |
| | Spin (rpm) | 2350 | 2350 | 2300 | 2250 | 2550 | 2500 | 2400 | 2450 |
| | Flight distance (m) | 214.9 | 214.9 | 214.9 | 214.9 | 212.6 | 212.1 | 209.9 | 213.1 |
| I#5 | Initial velocity (m/s) | 49.4 | 49.4 | 49.3 | 49.2 | 49.5 | 49.4 | 49.0 | 49.4 |
| | Spin (rpm) | 3700 | 3650 | 3600 | 3650 | 3950 | 3900 | 3750 | 3800 |
| | Flight distance (m) | 159.6 | 159.6 | 160.0 | 159.6 | 157.7 | 157.3 | 155.4 | 158.2 |

As shown in Table 5, the golf ball of each Example is excellent in the flight performance. Therefore, advantages of the present invention are clearly suggested by these results of evaluation.

The description hereinabove is merely for illustrative examples, and various modifications can be made without departing from the principles of the present invention.

What is claimed is:

1. A golf ball comprising a core and a cover positioned outside the core, wherein;

the core has a center and a mid layer positioned outside the center, and a hollow space is located within the center, the center has an inside diameter of 2 mm or greater and 13 mm or less, the center has an outside diameter of 5 mm or greater and 15 mm or less, a JIS-C hardness H2 of a surface of the center is 25 or greater and 55 or less, and a difference (H4−H3) between a JIS-C hardness H4 of a surface of the core and a JIS-C hardness H3 of an innermost part of the mid layer is equal to or greater than 10.

2. The golf ball according to claim 1, wherein a difference (H2−H1) between the hardness H2 and a hardness H1 of an innermost part of the center is 1 or greater and 15 or less.

3. The golf ball according to claim 1, wherein a difference (H3−H2) between the hardness H3 and the hardness H2 is equal to or less than 35.

4. The golf ball according to claim 1, wherein a difference (H4−H2) between the hardness H4 and the hardness H2 is equal to or greater than 40.

5. The golf ball according to claim 1, wherein the JIS-C hardness H1 of an innermost part of the center is equal to or less than 35.

6. The golf ball according to claim 1, wherein the hardness H3 is 45 or greater and 75 or less.

7. The golf ball according to claim 1, wherein the hardness H4 is 65 or greater and 90 or less.

8. The golf ball according to claim 1, wherein;

the center is formed by crosslinking a rubber composition, and the rubber composition contains sulfur as a crosslinking agent.

9. The golf ball according to claim 8, wherein the rubber composition contains 100 parts by weight of a base rubber and 2.0 parts by weight or greater and 10.0 parts by weight or less of the sulfur.

10. The golf ball according to claim 8, wherein the rubber composition contains 100 parts by weight of the base rubber and 0.5 parts by weight or greater and 7.0 parts by weight or less of a vulcanization accelerator agent.

11. The golf ball according to claim 8, wherein the rubber composition contains 100 parts by weight of the base rubber and 3 parts by weight or greater and 20 parts by weight or less of silica.

12. The golf ball according to claim 1, wherein the rubber composition for the center contains a natural rubber.

13. The golf ball according to claim 1, wherein;

the mild layer is formed by crosslinking a rubber composition, and a base rubber of the rubber composition contains polybutadiene as a principal component.

14. The golf ball according to claim 13, wherein the rubber composition contains 0.1 parts by weight or greater and 1.5 parts by weight or less of an organic sulfur compound per 100 parts by weight of the base rubber.

15. The golf ball according to claim 1, wherein the mid layer has a thickness of 10 mm or greater and 20 mm or less.

16. The golf ball according to claim 1, wherein;

the cover includes an inner cover and an outer cover, and a Shore D hardness H5 of the inner cover is smaller than a Shore D hardness H6 of the outer cover.

17. The golf ball according to claim 16, wherein a difference (H6–H5) between the hardness H6 and the hardness H5 is equal to or greater than 10.

18. The golf ball according to claim 16, wherein the hardness H5 is 20 or greater and 50 or less.

19. The golf ball according to claim 16, wherein the hardness H6 is equal to or greater than 57.

20. The golf ball according to claim 16, wherein;

the inner cover is made of a thermoplastic resin composition, and the outer cover is made of a thermoplastic resin composition.

* * * * *